US005299910A

United States Patent [19]

Gilchrist

[11] Patent Number: 5,299,910

[45] Date of Patent: Apr. 5, 1994

[54] FULL-ROUND COMPRESSOR CASING ASSEMBLY IN A GAS TURBINE ENGINE

[75] Inventor: Alan R. Gilchrist, Fairfield, Ohio

[73] Assignee: General Electric Company, Cincinnati, Ohio

[21] Appl. No.: 28,923

[22] Filed: Mar. 4, 1993

Related U.S. Application Data

[63] Continuation of Ser. No. 824,274, Jan. 23, 1992, abandoned.

[51] Int. Cl.[5] ..... F01D 9/02

[52] U.S. Cl. ..... 415/209.3; 415/209.2; 415/189

[58] Field of Search ..... 415/208.1, 209.2, 209.3, 415/189, 190

[56] References Cited

U.S. PATENT DOCUMENTS

| | | | |
|---|---|---|---|
| 2,843,357 | 7/1958 | Spindler | 415/189 |
| 2,928,586 | 3/1960 | Hart | 415/209.2 |
| 3,024,968 | 3/1962 | Payne et al. | 415/209.2 |
| 3,026,087 | 3/1962 | Welsh | 415/190 |
| 3,751,180 | 8/1973 | Cameron | 415/208.1 |
| 3,997,280 | 12/1976 | Germain | 415/189 |
| 4,014,627 | 3/1977 | Heurteux | 415/189 |
| 4,426,191 | 1/1984 | Brodell et al. | 415/189 |
| 4,431,373 | 2/1984 | Monsarrat | 415/189 |
| 4,543,039 | 9/1985 | Ruis et al. | 415/189 |

*Primary Examiner*—Edward K. Look

*Assistant Examiner*—Mark Sgantzos

*Attorney, Agent, or Firm*—Jerome C. Squillaro

[57] ABSTRACT

A full-round compressor casing assembly is employed in a gas turbine engine which includes alternating axially-arranged stages of movable blades and stationary vanes, with each stage of movable blades having a row of rotor blades attached to and extending radially outwardly from a rotor and each stage of stationary vanes having a row of stator vanes. The full-round casing assembly includes a plurality of vane sectors with the vanes projecting therefrom in defining each stage of stationary vanes, an inner casing inserted over the rotor and blades, and an outer casing inserted over the inner casing and spaced radially outwardly therefrom. The inner casing includes alternating axially-arranged full-round shroud bands and mounting bands. Each shroud band encircles the outer ends of the rotor blades. Each mounting band has a circumferential guide track on an interior side mounting the vane sectors in side-by-side relation around the mounting band with the vanes extending radially inwardly. Also, each mounting band has one or more openings to allow inserting the vane sectors one at a time from an exterior side of the mounting band through the openings to the mounting track and indexing the vane sectors around the interior of the mounting band in order to assemble the vane sectors and vanes to the inner casing after the rotor blades have been assembled to the rotor and the inner casing has been inserted over the rotor blades.

3 Claims, 3 Drawing Sheets

FULL-ROUND COMPRESSOR CASING ASSEMBLY IN A GAS TURBINE ENGINE

This application is a continuation of application Ser. No. 07/824,274, filed Jan. 23, 1992 now abandoned.

BACKGROUND OF THE INVENTION

1. Field of the Invention

The present invention relates generally to gas turbine engines and, more particularly, to a full-round compressor casing assembly in a gas turbine engine.

2. Description of the Prior Art

Gas turbine engines typically include a core engine having a compressor for compressing air entering the core engine, a combustor where fuel is mixed with the compressed air and then burned to create a high energy gas stream, and a first or high pressure turbine which extracts energy from the gas stream to drive the compressor. In aircraft turbofan engines, a second turbine or low pressure turbine located downstream from the core engine extracts more energy from the gas stream for driving a forward fan. The forward fan provides the main propulsive thrust generated by the engine.

The compressor typically includes multiple alternating axially-arranged stages of movable blades and stationary vanes. Each stage of movable blades includes a row of blades attached to one of a plurality of rotating rotor discs. Each stage of stationary vanes includes a row of vanes attached to an outer casing encompassing the stages of movable blades and stationary vanes.

Outer casings of compressors typically fall generally in three different prior art design categories: a split line 180° assembly, a sector assembly, and a bolted stage assembly. In the split line 180° casing assembly design, the vanes are assembled into two casing halves and then joined around the rotor structure by means of two horizontal split line flanges. In the sector casing assembly design, vane sectors are assembled around the rotor structure for all stages, then a full-round casing is slipped over the assembly to lock all sectors in place. In the bolted stage casing assembly, full-round stator nozzle assemblies which have rotor shrouding cantilevered off the stator are stacked with the rotor structure and then fastened together by bolted joints.

SUMMARY OF THE INVENTION

The present invention provides a full-round compressor casing assembly design which combines the advantages of the three prior art designs, while minimizing their disadvantages. In particular, the full-round compressor casing assembly of the present invention combines the vane assembly of the prior art split line 180° casing assembly design with the outer casing feature of the prior art sector casing assembly design to provide a true full round rotor shroud, as found in the prior art bolted stage casing assembly design, without the bolted joints and stacked construction of the latter prior art design. The full-round compressor casing assembly of the present invention finds general application in all turbomachinery that utilizes axial stage compressors.

Accordingly, the present invention is directed to a full-round compressor casing assembly set forth in a gas turbine engine. The gas turbine engine includes alternating axially-arranged stages of movable blades and stationary vanes. Each stage of movable blades has a row of rotor blades attached to and extending radially outwardly from a rotor. Each stage of stationary vanes has a row of stator vanes.

The full-round casing assembly of the present invention comprises: (a) a plurality of vane sectors with vanes projecting therefrom defining each stage of stationary vanes; (b) an inner casing inserted over the rotor and blades; and (c) an outer casing inserted over the inner casing and spaced radially outwardly therefrom. The inner casing includes alternating axially-arranged full-round shroud bands and mounting bands.

Further, each shroud band encircles outer ends of the rotor blades. Each mounting band has means located on an interior side thereof defining a circumferential guide track which mounts the vane sectors in side-by-side relation circumferentially around the mounting band. The vane sectors are mounted to the guide track such that the vanes extend radially inwardly therefrom.

Also, each mounting band has at least one opening to allow inserting the vane sectors one at a time from an exterior side of the mounting band through the opening to the mounting track and indexing the vane sectors around the interior of the mounting band in order to assemble the vane sectors and vanes to the inner casing after the rotor blades have been assembled to the rotor and the inner casing has been inserted over the rotor blades.

These and other features and advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
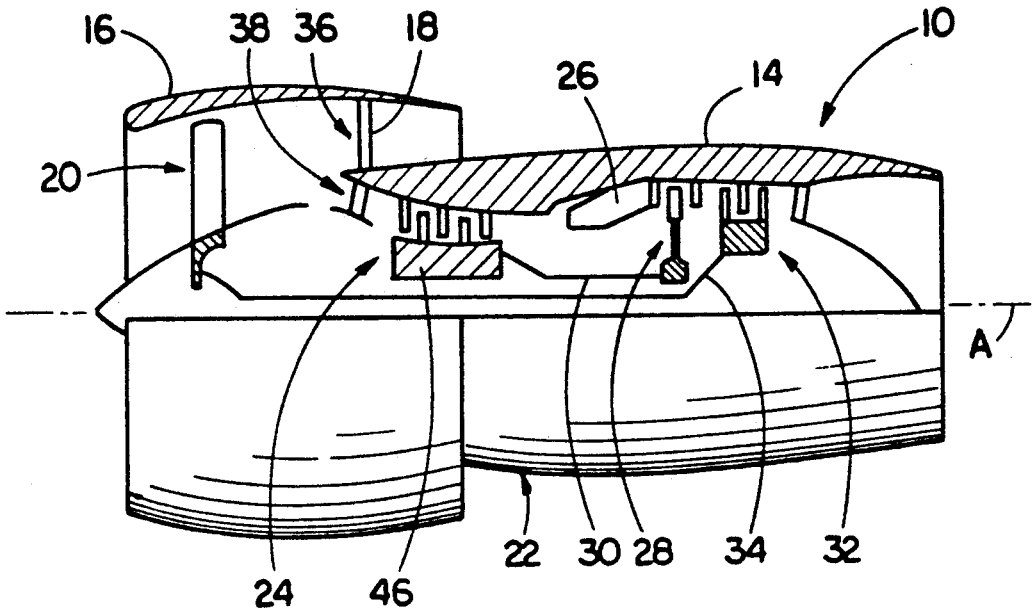
FIG. 1 (PRIOR ART)
FIG. 1 is a schematic representation of a prior art gas turbine engine in which the full-round compressor casing assembly of the present invention can be employed.

In the following description, like reference characters designate like or corresponding parts throughout the several views. Also in the following description, it is to be understood that such terms as "forward", "rearward", "left", "right", "upwardly", "downwardly", and the like, are words of convenience and are not to be construed as limiting terms.

Prior Art Gas Turbine Engine

Referring now to the drawings, and particularly to FIG. 1, there is schematically illustrated a prior art gas turbine engine, generally designated 10, to which can be applied the full-round compressor casing assembly 12 (FIGS. 2-7) of the present invention. The engine 10 has a longitudinal center line or axis A and an outer stationary annular casing 14 and nacelle 16 disposed coaxially and concentrically about the axis A. The nacelle 16 is supported about the forward end of the casing 14 by a plurality of struts 18, only one of which being shown in FIG. 1.

The engine 10 includes a forward fan 20 disposed within the nacelle 16 and a core gas generator engine 22 disposed rearwardly of the fan 20 and within the stationary casing 14. The core engine 22 is composed of a multi-stage compressor 24, a combustor 26, and a high pressure turbine 28, either single or multiple stage, all arranged coaxially about the longitudinal axis A of the engine 10 in a serial, axial flow relationship. An annular outer drive shaft 30 fixedly interconnects the compressor 24 and high pressure turbine 28. The engine 10 further includes a low pressure turbine 32 disposed rearwardly of the high pressure turbine 28. The low pressure turbine 32 is fixedly attached to an inner drive shaft 34 which, in turn, is connected to the forward fan 20. Conventional bearings and the like have been omitted from FIG. 1 in the sake of clarity.

In operation, air enters the gas turbine engine 10 through an air inlet of the nacelle 16 surrounding the forward fan 20. The air is compressed by rotation of the fan 20 and thereafter is split between an outer annular passageway 36 defined between the nacelle 16 and the engine casing 14, and a core engine passageway 38 having its external boundary defined by the engine casing 14. The pressurized air entering the core engine passageway 38 is further pressurized by the compressor 24. Pressurized air from the compressor 24 is mixed with fuel in the combustor 26 and ignited, thereby generating combustion gases. Some work is extracted from these gases by the high pressure turbine 28 which drives the compressor 24. The remainder of the combustion gases are discharged from the core engine 22 into the low pressure power turbine 32 to drive the forward fan 20. The portion of the air flow provided from the fan 20 through the outer passageway 36 produces the main propulsive thrust generated by the engine 10.

Full-Round Compressor Casing Assembly of Present Invention

Referring now to FIGS. 2-7, there is illustrated the full-round compressor casing assembly 12 of the present invention which can be employed by the engine 10 of FIG. 1. The full-round casing assembly 12 of the present invention is preferably applied to the compressor 24 of the core engine 22.

Figure 2:
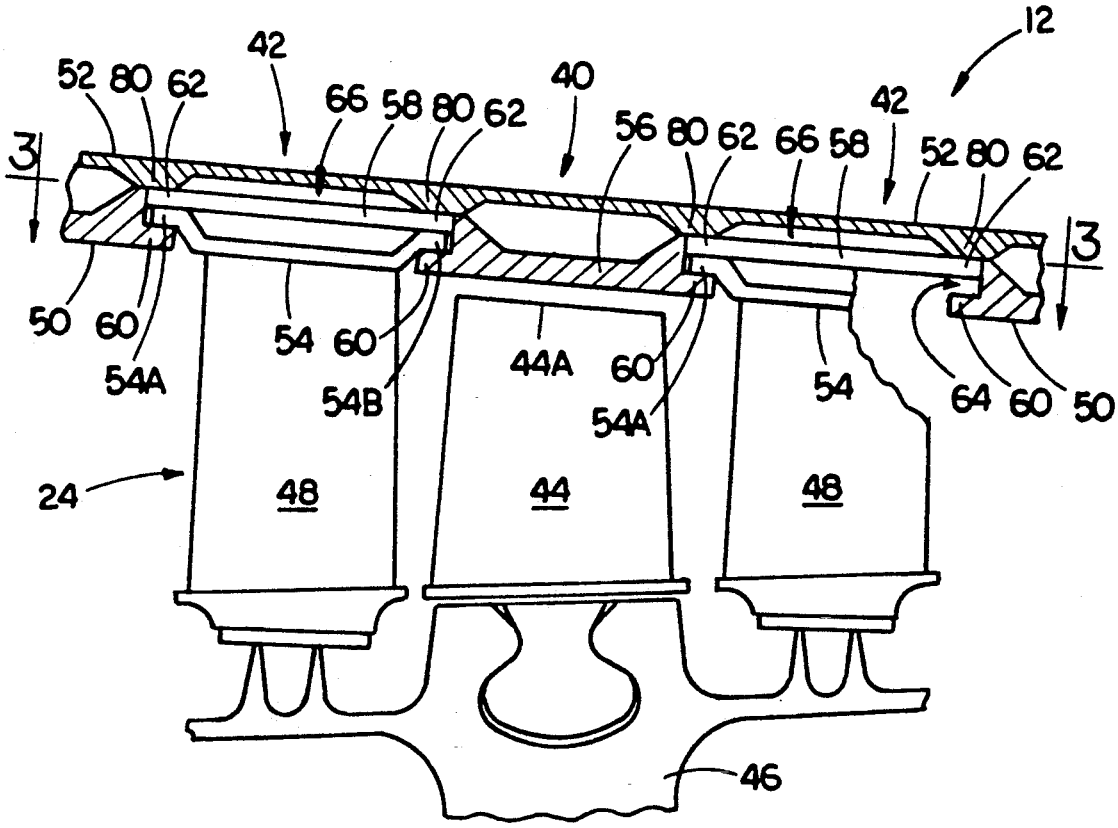
FIG. 2 is an enlarged fragmentary longitudinal axial sectional view of the casing assembly of the present invention.

As best seen in FIG. 2, the compressor 24 typically includes multiple alternating axially-arranged stages 40, 42 of movable blades and stationary vanes. Each stage 40 of movable blades includes a row of rotor blades 44 attached to and extending radially outwardly from a rotatable rotor 46 which, in turn, is mounted to the outer drive shaft 30 (FIG. 1). Each stage 42 of stationary vanes includes a row of stator vanes 48.

The full-round casing assembly 12 of the present invention basically includes an inner casing 50 (see FIGS. 2 and 5) which is inserted over the fully assembled rotor blades 44 and an outer casing 52 (see FIGS. 2 and 4) which inserts over the inner casing 50 and spaced radially outwardly from the inner casing 50. The assembly 12 also includes a plurality of vane sectors 54 having the stator vanes 48 projecting therefrom in defining each stage 42 of the stationary vanes.

Figure 5:
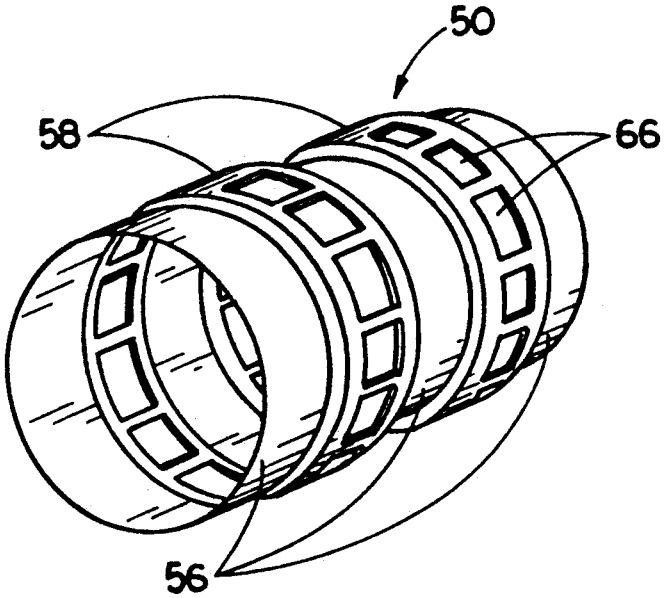
FIG. 5 is a perspective view of the inner casing of the full-round compressor casing assembly of the present invention.
Figure 4:
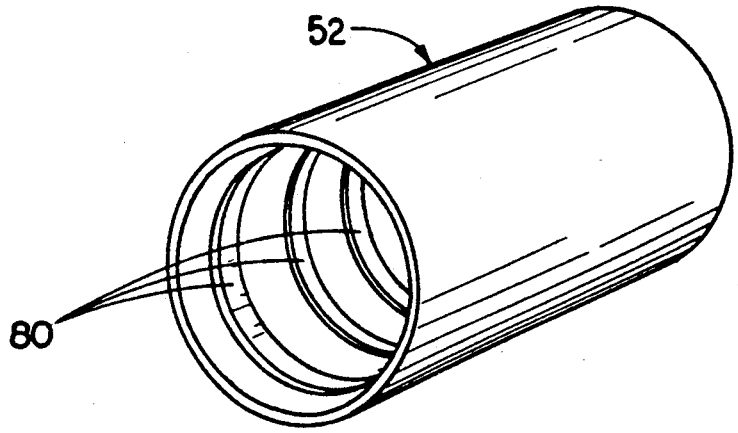
FIG. 4 is a perspective view of the outer casing of the full-round compressor casing assembly of the present invention.

As best seen in FIG. 5, the inner casing 50 of the casing assembly 12 is composed of multiple alternating, axially-arranged full-round shroud bands 56 and mounting bands 58. The shroud and mounting bands 56, 58 are preferably rigidly connected together. Each shroud band 56 encircles outer ends 44A (see FIG. 2) of the rotor blades 44 of one stage 40 of movable blades. Each shroud band 56 can be composed of a plurality of circumferentially-arranged shroud sectors (not shown).

Figure 3:
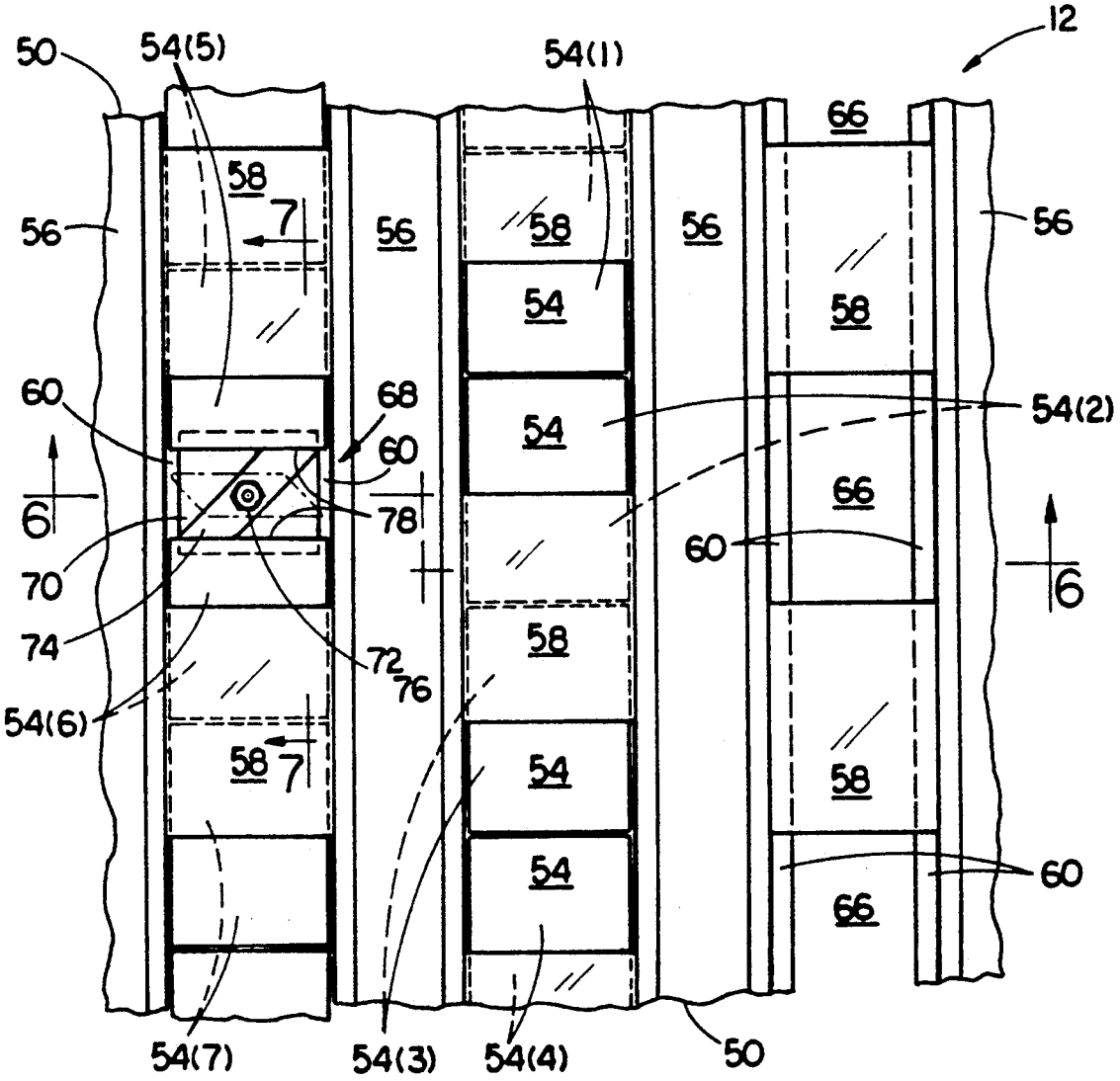
FIG. 3 is a fragmentary planar layout view of the casing assembly taken along line 3—3 of FIG. 2. Shown are three mounting bands of the inner casing illustrating different steps in the assembling of the vane sectors within the inner casing. In the far right mounting band, no vane sectors have been inserted in the inner casing; in the middle mounting band, a plurality of vane sectors have been inserted; and in the far left mounting band, the device for circumferentially locking the vane sectors in position is shown.
Figure 6:
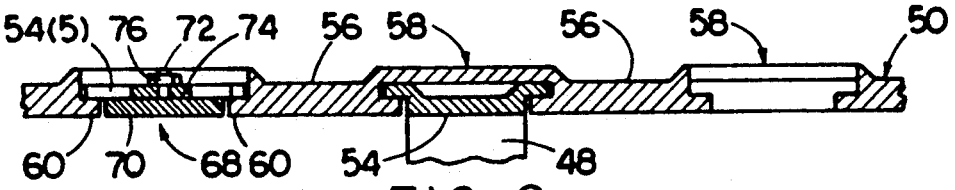
FIG. 6 is a sectional view taken along line 6—6 of FIG. 3 of the casing assembly of the present invention.

Again referring to FIG. 2, and also to FIGS. 3 and 6, each shroud band 56 has a pair of axially spaced, opposite facing, lower rails 60 attached on an interior side of the shroud band 56. The lower rails 60 and the upper opposite edges 62 of the mounting band 58, which connect with adjacent shroud bands 56, form a pair of facing grooves which define a circumferential guide track 64 for mounting the vane sectors 54 (and associated vanes 48 therewith) in side-by-side relation circumferentially around the mounting band 58. The vane sectors 54 are in the shape of generally rectangular, flat, but slightly arcuate, plates which at their opposite forward and rearward edge portions 54A, 54B (FIG. 2) will fit in the facing grooves of the guide track 64. With the vane sectors 54 thusly supported by the guide track 64, the vanes 48 extend radially inwardly toward the central axis A of the engine 10.

Also, each mounting band 58 has at least one and preferably a plurality of circumferentially spaced openings 66 defined therethrough. As best seen in the mounting band 58 located on the far right of FIG. 3, only the lower rails 60 of the guide track 64 are present at the location of the openings 66. The openings 66 have generally rectangular shapes and dimensions to allow inserting the vane sectors 54 one at a time from an exterior side of the mounting band 58 through the opening 66 to the lower rails 60 of the guide track 64. After insertion, the vane sector 54 is indexed around the interior of the mounting band 58 by sliding along the guide track 64 below the band 58 through a distance of approximately one-half the circumferential length of a vane sector 54 as illustrated by vane sectors 54(1)-54(4) seen in the mounting band 58 located in the middle of FIG. 3. The vane sectors 54 are retained along the guide track 64 by the facing grooves extending between the spaced openings 66. In such manner, the vane sectors 54, and the vanes 48 attached thereon, can be assembled to the inner casing 50 after the rotor blades 44 have been assembled to the rotor 46 and the inner casing 50 has been inserted over the rotor blades 44.

Figure 7:
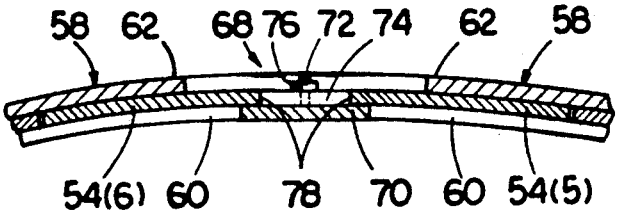
FIG. 7 is a sectional view taken along line 7—7 of FIG. 3 of the casing assembly of the present invention, further illustrating the device for circumferentially locking the vane sectors in position.

The casing assembly 12 also includes a locking device 68 for retaining the vane sectors 54 assembled in contacting side-by-side relation about the circumferential guide track 64. The locking device 68 can take any suitable form. In an exemplary form shown in the mounting band 58 located on the far left of FIG. 3, and also seen in FIGS. 6, and 7, the locking device 68 includes a closure plate 70, a stud 72 having one end containing threads and with its other end being attached to the center of the plate 70 and projecting outwardly from the outer surface of the plate 70, a locking arm 74 with a central bore for rotatably mounting the arm 74 on the stud 72, and a nut 76 for releasably fastening the arm 74 against the plate 70 in order to lock the arm 74 in a desired angular position, such as seen in FIG. 3, in which the opposite ends of the arm 74 is in abutting engagement with and extending between the two vane sectors 54(5) and 54(6) whose adjacent ends are exposed in the opening 66. The closure plate 70 is inserted through the space or gap 78 between the adjacent ends of the vane sectors 54(5) and 54(6) and has a dimension in the circumferential direction slightly greater than the circumferential width of the gap 78 such that the opposite ends of the plate 70 overlap the underside of the adjacent ends of the vane sectors 54(5) and 54(6), as seen in FIG. 7, so as to close the gap 78 between the vane sectors. After the closure plate 70 has been inserted through the gap 78 and positioned in its overlapping position under the adjacent ends of the vane sectors 54(5) and 54(6), the locking arm 74 is rotated from its dotted line inserting position to its solid line locking position, as illustrated in FIG. 3, and then the fastening nut 76 is threadably tightened on the threaded end of the stud 72 so as to retain the arm 74 in its locking position and thereby the vane sectors 54 in their contacting side-by-side relation about t he circumferential guide track 64.

In summary, the inner casing 50 is the rotor flowpath casing and the one that supports the stator vane sectors 54. The outer casing 52 is a hollow sleeve, being of a one piece cylindrical construction, having internal ribs 80 that abut the top surface of the mounting band edges 62 and is the casing that reacts the pressure vessel loads. The outer casing 52 can also provide stage sealing and an allowance for flow swirling around the rotor shroud sections for improved heat transfer and rotor blade tip clearance control. The outer casing 52 is designed to have a slight interference fit at assembly and an increase in fit as the turbomachinery operates to maintain interference over the full operating range.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinbefore described being merely preferred or exemplary embodiments thereof.

I claim:

1. In a gas turbine engine having alternating axially-arranged stages of movable blades and stationary vanes, each stage of movable blades including a row of rotor blades attached to and extending radially outwardly from a rotor, each stage of stationary vanes including a row of stator vanes, a full-round casing assembly comprising;

(a) a plurality of vane sectors with said vanes projecting therefrom defining each stage of stationary vanes;

(b) an inner casing inserted over said rotor and blades; and (c) an outer casing inserted over said inner casing and spaced radially outwardly therefrom;

(d) said inner casing including alternating axially-arranged full-round bands, said bands including at least one shroud band encircling outer ends of said rotor blades and at least one mounting band having means on an interior side thereof for mounting said vane sectors circumferentially in side-by-side relation around said mounting band such that said vanes extend radially inwardly therefrom;

(e) wherein said mounting means is a circumferential guide track defined on said interior side of said mounting band and extending around said mounting band; and (f) wherein said mounting band has at least one opening to allow inserting said vane sectors one at a time from an exterior side of said mounting band through said opening to said guide track and indexing said vane sectors around the interior of said mounting band in order to assemble said vane sectors and vanes to said inner casing after rotor blades have been assembled to said rotor and said inner casing has been inserted over said rotor blades.

2. In a gas turbine engine having alternating axially-arranged stages of movable blades and stationary vanes, each stage of movable blades including a row of rotor blades attached to and extending radially outwardly from a rotor, each stage of stationary vanes including a row of stator vanes, a full-round casing assembly comprising;

(a) a plurality of vane sectors with said vanes projecting therefrom defining each stage of stationary vanes;

(b) an inner casing inserted over said rotor and blades; and (c) an outer casing inserted over said inner casing and spaced radially outwardly therefrom;

(d) said inner casing including alternating axially-arranged full-round bands, said bands including at least one shroud band encircling outer ends of said rotor blades and at least one mounting band having means on an interior side thereof for mounting said vane sectors circumferentially in side-by-side relation around said mounting band such that said vanes extend radially inwardly therefrom;

(e) wherein said mounting means is a circumferential guide track defined on said interior side of said mounting band and extending around said mounting band;

(f) wherein said mounting band has a pair of axially spaced rails attached on said interior side of said mounting band;

(g) wherein said rails and mounting band form a pair of facing grooves between them which define said circumferential guide track for mounting said vane sectors in side-by-side relation circumferentially around said mounting band;

(h) wherein said vane sectors are in the shape of generally rectangular, flat, but slightly arcuate, plates which at their opposite forward and rearward edge portions fit in said facing grooves of said guide track; and (i) wherein said mounting band has at least one opening to allow inserting said vane sectors one at a time from an exterior side of said mounting band through said opening to said guide track and indexing said vane sectors around the interior of said mounting band in order to assemble said vane sectors and vanes to said inner casing after rotor blades have been assembled to said rotor and said inner casing has been inserted over said rotor blades.

3. The casing assembly as recited in claim 2, wherein said opening in said mounting band has a generally rectangular shape and dimensions to allow inserting said vane sectors one at a time from said exterior side of said mounting band through said opening onto said guide track.

* * * * *